United States Patent [19]

Fain et al.

[11] Patent Number: 4,630,181

[45] Date of Patent: Dec. 16, 1986

[54] FLUORESCENT LIGHTING FIXTURE

[75] Inventors: Elmer E. Fain, Carthage; Charles O. Sutton, Diamond, both of Mo.

[73] Assignee: H. E. Williams, Inc., Carthage, Mo.

[21] Appl. No.: 755,165

[22] Filed: Jul. 15, 1985

[51] Int. Cl.[4] ..... F21V 7/00; F21V 17/02

[52] U.S. Cl. ..... 362/235; 362/260; 362/279; 362/290; 362/300; 362/303; 362/319; 362/325; 362/342

[58] Field of Search ..... 362/227, 235, 257, 260, 362/277, 279, 290, 296, 297, 298, 300, 303, 317, 319, 322, 325, 341, 342

[56] References Cited

U.S. PATENT DOCUMENTS

| | | | |
|---|---|---|---|
| 1,659,409 | 2/1928 | Porter | 362/279 |
| 2,830,330 | 4/1958 | Heath | 362/290 |
| 3,774,024 | 11/1973 | Deaton | 362/319 |
| 3,996,458 | 12/1976 | Jones | 362/290 |
| 4,222,094 | 9/1980 | Wolar | 362/279 |
| 4,233,651 | 11/1980 | Fabbri | 362/260 |
| 4,261,028 | 4/1981 | Adam | 362/279 |
| 4,494,175 | 1/1985 | Gawad et al. | 362/342 |

*Primary Examiner*—Craig R. Feinberg
*Attorney, Agent, or Firm*—John A. Hamilton

[57] ABSTRACT

A lighting fixture consisting of a downwardly opening housing having a plurality of fluorescent lamps mounted therein, a louver assembly substantially closing the open bottom of the housing and dividing its area into vertically open cells only certain of which receives light from each of the lamps, the louvers being of sufficient vertical height to restrict light passing directly through the cells to a restricted primary area of brighter illumination in the room below, and a translucent light-diffusing panel covering the cells of the louver assembly receiving light from each of the lamps. The lamps may be selected to emanate light of respectively different colors, and both the louvers and the light-diffusing panels may be of selectively different tints and colors, so as to impart a novel, decorative appearance to the louver assembly when viewed from outside of the primary lighting area.

2 Claims, 9 Drawing Figures

FLUORESCENT LIGHTING FIXTURE

Figure 1:
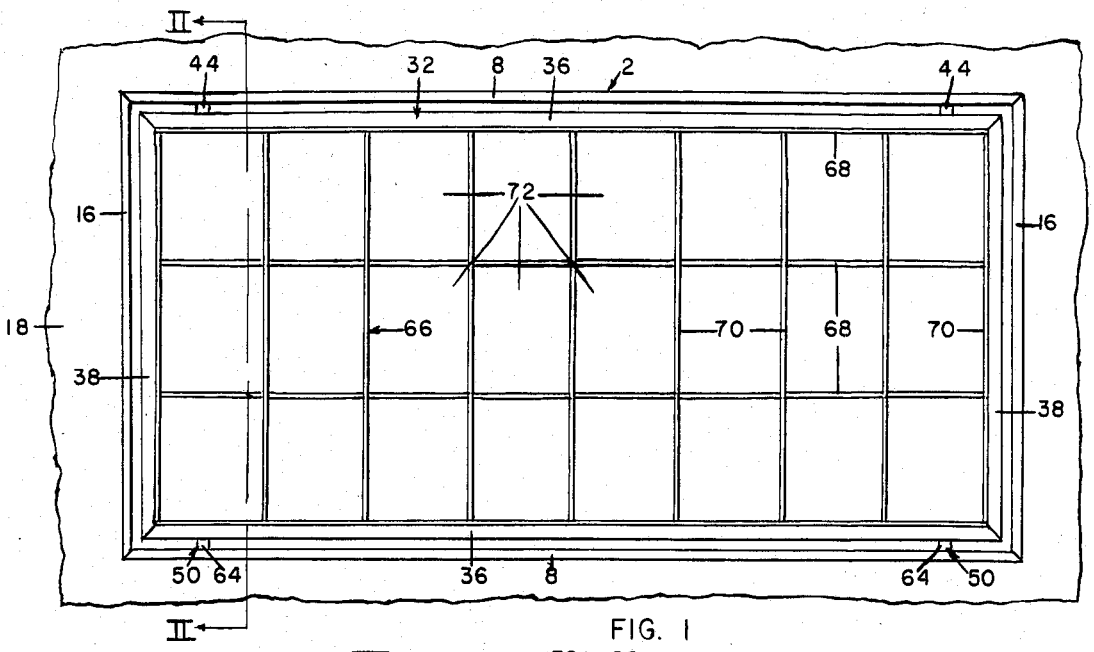

This invention relates to new and useful improvements in fluorescent light fixtures, and has particular reference to such fixtures adapted for use at ceiling level, for illuminating room areas therebeneath. It also has adaptability to light fixtures in which the lamps are of other than the fluorescent type. In general, objects of the invention include the efficiency of the room lighting, for example in limiting the room area subjected to the primary or brightest lighting effect, to provide bright illumination for a given work station or the like with relatively dim light being supplied to areas outside of that work station, and also the improvement of the appearance of the fixture, especially when viewed from outside the area of primary illumination mentioned above, by the novel use of color.

More specifically, one object of the present invention is the provision of a lighting fixture including a downwardly opening housing carrying a plurality of fluorescent lamp tubes in the upper portion thereof, a louver assembly disposed in the lower opening of said housing and comprising a gridwork of vertical-walled cells each of which receives light principally from only one of said lamps, and a plurality of translucent light-diffusing panels overlying the top of said louver assembly to provide even illumination of all of the louver cells. The louvers are of substantial vertical height, whereby to direct the light emerging from the lower side thereof more directly downwardly than would be the case if the louvers were not used. This provides a primary room area directly beneath the fixture with a higher degree of illumination, while reducing illumination of surrounding areas, where bright illumination might be objectionable to other occupants of the room.

Another object is the provision of a lighting fixture of the character described in which said louver assembly is vertically adjustable in said housing, relative to the fluorescent lamps. This provides for adjustment of the size of the primary area of bright illumination, as may be desired.

A further object is the provision of a lighting fixture of the character described in which the fluorescent lamps themselves may be selected to emanate light of different colors, in which the light-diffusing diffusing panels are tinted so that each transmits light of a different color, and in which the louvers forming the cell walls are painted or otherwise finished in any desired color or combination of colors. While the lamps and the light-diffusing panels usually must be selected to transmit light of sufficient intensity and suitable color for proper illumination in the primary area, although substantial variation is permissable even in this area, the coloring of the louvers imparts a distinctly novel and decorative appearance to the fixture, especially when viewed from outside the primary area. By careful selection and intermingling of all of these variables, the fixture itself may become an integral and important element of room decor, harmonizing or contrasting attractively with any plans of the interior decorator.

Other objects are simplicity and economy of construction, and efficiency, flexibility and reliability of operation.

Figure 2:
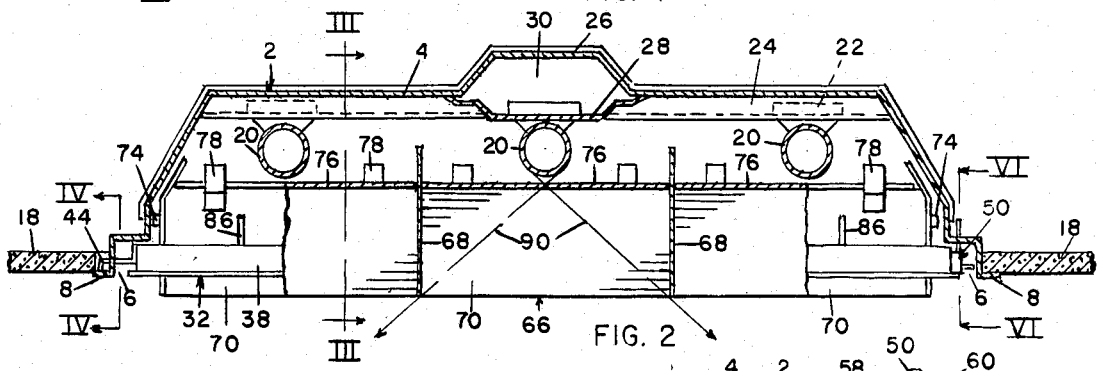
Figure 3:
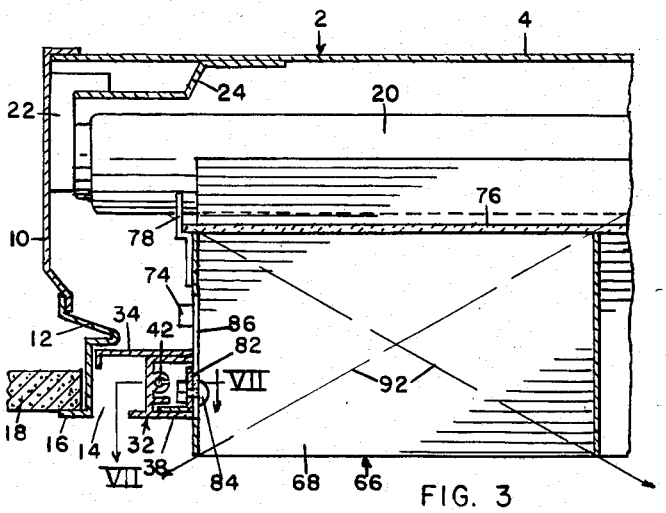
Figure 6:
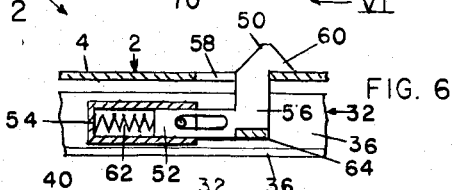
Figure 7:
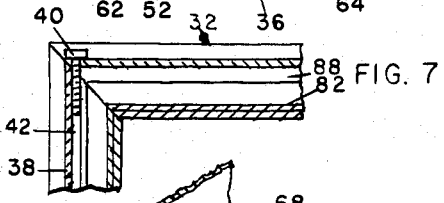
Figure 8:
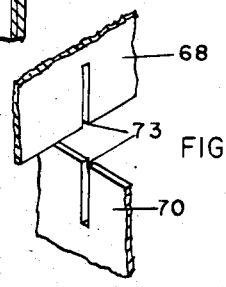
Figure 4:
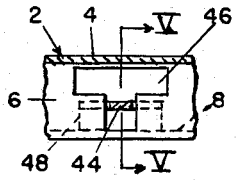
Figure 5:
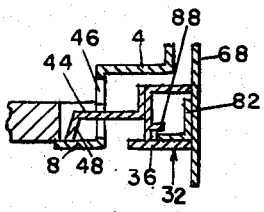
Figure 9:
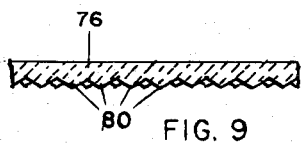

With these objects in view, as well as other objects which will appear in the course of the specification, reference will be had to the accompanying drawing, wherein:

FIG. 1 is a bottom plan view of a fluorescent lighting fixture embodying the present invention, FIG. 2 is an enlarged sectional view taken on line II—II of FIG. 1, with parts left in elevation and partially broken away, FIG. 3 is an enlarged, fragmentary sectional view taken on line III—III of FIG. 2, FIG. 4 is an enlarged, fragmentary sectional view taken on line IV—IV of FIG. 2, FIG. 5 is a fragmentary sectional view taken on line V—V of FIG. 4, FIG. 6 is an enlarged, fragmentary sectional view taken on line VI—VI of FIG. 2, FIG. 7 is an enlarged, fragmentary sectional view taken on line VII—VII of FIG. 2, taken at a corner of the door frame, illustrating the means of assembling said frame, FIG. 8 is an exploded perspective view illustrating the means of connecting the longitudinal and transverse louvers at their points of intersection, and FIG. 9 is an enlarged sectional view of one of the light-diffusing panels.

Like reference numerals apply to similar parts throughout the several views, and the numeral 2 applies generally to the light fixture housing, comprising a downwardly opening, elongated trough 4 formed of sheet metal, which forms, at each longitudinal edge thereof, a shallow, downwardly opening cove 6 having an out-turned horizontal flange 8 at its extreme lower edge. Each end of the trough 4 is closed by a sheet metal end plate 10 (see FIG. 3) having at its lower edge a sheet metal insert 12 which provides a cove 14 and flange 16 similar to, and at the same elevation as, cove 6 and flange 8 of the trough, but at the ends of the housing. Housing 2 may be suspended from a permanent room ceiling by wires or any other suitable means, not shown, and drop-ceiling acoustical panels 18 may be supported on flanges 8 and 16, as shown and as well known in the art.

A plurality (three shown) of fluorescent lamp tubes 20, or other electric lamps extend longitudinally in the upper portion of the housing, in evenly spaced relation across its width. Each lamp tube is engaged at each end (one end shown in FIG. 3), in a socket member 22 carried by a bracket 24 fixed to the top of trough 4. A longitudinal hump 26 formed centrally in the top of trough 4, and a cover plate 28 applied to said trough immediately beneath said hump, provides a space 30 for containing any necessary electrical ballast, and for containing wires extending to the ends of the housing, and brackets 24 provide wire-ways to the individual sockets 22. However, said ballast and wiring are well known in the art, and are not shown, not being considered pertinent to the present invention.

Normally disposed horizontally within the lower opening of housing 2, and with its edges engaging loosely within side coves 6 and end coves 14, is a rectangular door frame indicated generally by the numeral 32. If it does not reach fully into a cove 14, as shown in FIG. 3, an extension plate 34 is attached thereto which extends outwardly sufficiently to engage in the cove, both to limit upward movement of the frame and to prevent downward escape of light which has not passed through the frame, in which the louver assembly to be described is mounted. Said door frame comprises a pair of side rails 36 and a pair of end rails 38. The side and end rails are preferably formed of extruded aluminum or the like, and as best shown in FIG. 7, are releasably joined at each corner of the frame by a horizontal screw 40 based in side rail 36 and threaded into a screw boss 42 which is extruded integrally with the end rail 38. By the removal of the four screws 40, the frame may be disassembled. Along one of its side edges, door frame 32 is hinged to trough 4 for pivotal movement on an axis parallel to said edge by a pair of hinges 44, each of said hinges comprising an arm fixed at its inner end to the door frame and extending outwardly through a T-shaped hole 46 formed in the vertical wall of cove 6, as best shown in FIGS. 4 and 5. The arm is provided at its outer end with a T-head 48 insertable through the top cross arm of hole 46, and turned downwardly to rest on trough flange 8 with the arm in the narrower upright portion of the hole. By lifting the frame slightly, T-head 48 may be retracted through the top cross arm of hole 46 to separate the door frame from the housing, when said door frame is inclined downwardly. The opposite side edge of the door frame is releasably secured in its corresponding cove 6 by a pair of latches each indicated generally by the numeral 50, and best shown in FIG. 6. Each latch comprises a bolt 52 horizontally slidable in a keeper 54 fixed to the door frame, said bolt having an upstanding finger 56 projecting upwardly through a slot 58 formed in the top horizontal wall of cove 6 and having a latch tooth 60 operable to overlap said cove wall to secure the door frame in a horizontal position. Said bolt is biased toward its engaging position by a spring 62 disposed in carrier 54, but is movable to its release position by a manually accessible finger 64 fixed thereto.

Carried within door frame 32 is a louver assembly designated generally by the numeral 66. Said assembly comprises a series of longitudinally extending louvers 68 and a series of transversely extending louvers 70, equally spaced to divide the area into a gridwork of identically shaped rectangular cells 72. All of the louvers are arranged with their planes disposed vertically. The louvers, at each of their points of intersection, are provided with slots 73 extending from their respectively upper and lower edges, as shown in FIG. 8, which interengage when the louvers are moved vertically into corresponding vertical alignment. Their lower edges are all coplanar, as are the upper edges of all of the transverse louvers, but the longitudinal louvers extend well above the upper edges of the transverse louvers, for a purpose which will presently appear. Each of lamps 20 is disposed above and midway between a successive pair of longitudinal louvers, and is parallel thereto, so as to illuminate principally only the longitudinal row of cells 72 directly therebeneath. The upward extension of the longitudinal louvers largely prevents and inhibits light from each lamp from reaching the adjacent row of cells illuminated by adjacent lamps, which as will appear may be emanating light of a different color. Each louver is provided at each end with at least one projecting "toy tab" 74 which is projected through a matching slot in the adjacent marginal louver and then twisted slightly, whereby to hold the louvers firmly in assembly. Each longitudinal row of cells 72 is covered by an elongated light-diffusing panel 76 resting on the upper edges of transverse louvers 70, being confined transversely between a successive pair of longitudinal louvers and secured against longitudinal movement by upstanding tabs 78 fixed to the endmost of transverse louvers 70 and projecting upwardly therefrom. These panels may be of any desired tints, either identical or different, and are translucent but not transparent in the sense of being able to distinguish clear images therethrough, a surface thereof being roughened or irregular for this purpose. A popular form for this roughening is the formation of a surface thereof in very small projecting pyramidal points 80, as indicated in FIG. 9.

Louver assembly 66 is mounted in door frame 32 by means of a horizontal sheet metal angle 82 extending horizontally along the outer surface of each of the marginal louvers, as best shown in FIGS. 3 and 5. The vertical leg of each of said angles is secured to the marginal louver by a bolt 84 (see FIG. 3) engaged in a vertical slot 86 of the louver. By loosening all of bolts 84, the louver assembly may be moved upwardly or downwardly relative to angles 82. The horizontal leg of each angle 82 projects outwardly into the adjacent rail of door frame 32, whereby the louver assembly is supported. The door frame rails are of inwardly opening C-channel form to receive the angle flanges, and are of substantial size to provide rigidity for the door frame, but each rail is provided with an internal flange 88 (see FIG. 5) for preventing excessive vertical movement of the horizontal angle flanges, which could result in rattling noises.

In operation, it will be understood that fluorescent lamps 20 may be selected to emanate light of either the same or different colors. Such lamps are at present most commonly designated either "cool white", the light from which peaks in the shorter wave lengths adjacent the blue end of the visible spectrum, or "warm white", the light from which peaks in the longer wave lengths adjacent the red end of the visible spectrum. However, fluorescent lamps emanating light of other colors are or may soon become available. The light from each lamp illuminates principally only the longitudinal row of louver cells 72 directly therebeneath, through its corresponding light-diffusing panel 76, illumination of adjacent cell rows being largely inhibited and prevented by the upward extension of longitudinal louvers 68 well above the panels 76. The light-diffusing panels may also be of the same or selectively different color tints. Since most commonly it will be desired that the fixture supply a bright, full illumination at least in a primary area of the room directly beneath the fixture, the colors of the panels will ordinarily be light, such as light ambers, grays and the like. However, the fixture may also be used to provide relatively dim "mood" light, or more strongly colored light for use in rooms not requiring bright illumination, and in such cases as this the light-diffusing panels could be more brightly or darkly colored. Light passing through these panels is diffused to illuminate the vertical walls of the louvers evenly, and the louvers in turn reflect the light downwardly to the room area. The louvers may also be of the same or selectively different colors. Opposite sides of even a single louver may be of different colors, or even different sections of the same side of a louver. Since the louvers themselves will ordinarily be viewed only from points of the room outside of the area of primary bright illumination directly beneath the fixture, their color is relatively immaterial to efficiency of room illumination, and the louvers may thus be utilized as a room decorating element, with the colors thereof harmonizing, contrasting, or otherwise enhancing virtually any conceivable room decor. Other fixtures could be placed over any other area of the room which requires bright illumination. The selection of black or charcoal-colored louvers produces an effect in which the fixture may almost appear to be not lighted at all, from anywhere outside of the primary area of bright illumination. The louver surfaces may be polished and highly reflective, or may be of a dull or matte finish to be highly light-absorptive. Still further novel effects may be obtained by providing lamps 20 with wiring and switching means whereby said lamps may be energized either singly or in various combinations, as is already well known in the art.

Light ray lines 90 in FIG. 2 and 92 in FIG. 3 indicate, when extended downwardly to the "living level" of the room, the span of the previously discussed primary area of bright illumination, since in this area light can reach the living level without being reflected from the louver surfaces. This restriction of said primary area is useful when the fixture is disposed over a work station of a room requiring bright illumination, while other areas of the room do not. This increases the room area from which the purely decorative appearance of the fixture may be viewed. Also, bearing in mind that while the light-diffusing panels 76 are not transparent, the lamps 20 above them still produce small areas of extreme brightness on the panels, visible from beneath the panels, which can reflect, for example, from the cathode ray tube readout screens of computers disposed in the room beneath. Such reflections are annoying and distracting to operators of the computers, and can sometimes obscure vital information displayed on the screens. With the present fixture, the computers can be placed outside of the primary illumination area, whereupon such reflections will not appear in the screens. The restriction of the room area subjected to bright illumination is accomplished by the substantial vertical width of the louvers 68 and 70, which is much greater than the thin "egg-crate" grills with which some fluorescent fixtures are already sometimes equipped, largely for the purpose of protecting the fluorescent lamps. In the present fixture, the effect may be increased by loosening bolts 84 and lowering the entire louver assembly relative to the lamps. Referring to FIGS. 2 and 3, it will be obvious that this lowering of the louvers will reduce the horizontal angle between ray lines 90 and 92, and thus reduce the area of the room below being subjected to the brighter light.

Thus it will be apparent that the structure described accomplishes the objects of the invention. The described fixture provides a primary area of bright illumination in a confined area of the room, while subjecting the remainder of the room to relatively subdued illumination. The dimensions of this primary area may be adjusted to a considerable extent. While the primary area might usually require bright illumination, it can be varied to any desired degree of relative dimness and color, to suit any "mood" or decor, or for use in rooms not requiring bright illumination, by the proper selection of lamps 20 to emanate light of different color makeup, and diffusion panels 76 of the desired color. When viewed from any part of the room outside of the primary area, the only illuminated portion of the fixture visible are the louvers themselves, which as described above may be of any desired color or combination of colors, thus constituting the fixture as a decorative ornament for the room, which may be varied as to color pattern to complement virtually any room decor. The "apparent" color of the louvers is a product not only of their own color, but also of the color of the light emanated by each lamp 20, the tint of the diffusion panels 76, and the reflectivity of the louvers. With the wide variability of each of these factors, altered either singly or in various combinations, the color combinations which may be produced are virtually infinite.

While we have shown and described a specific embodiment of our invention, it will be readily apparent that many minor changes of structure and operation could be made without departing from the spirit of the invention.

What we claim as new and desire to protect by Letters Patent is:

1. A lighting fixture comprising:

a. a fixture housing having a hollow interior and being open at its bottom, b. a plurality of fluorescent lamp tubes disposed in horizontal, parallel relation in an upper portion of the hollow interior of said housing, c. a louver assembly mounted in and covering the open bottom of said housing, said assembly defining a horizontal area and comprising spaced longitudinal louvers extending parallel to said lamp tubes and transverse louvers extending at right angles to said longitudinal louvers to divide the horizontal area of the assembly into vertically open cells, each longitudinal row of said cells being centered beneath one of the lamp tubes, the individual louvers being disposed in vertical planes and being of substantial vertical width to restrict light passing downwardly through said cells directly from said lamps to a primary area of relatively bright illumination directly beneath said fixture, d. a plurality of non-transparent but translucent light-diffusing panels each covering one of the longitudinal rows of said cells, said panels being of any desired color, and said longitudinal louvers extending well above said panels to inhibit light from any one of said lamp tubes from reaching any panel not directly therebeneath, and e. means rendering said lower assembly vertically adjustable in said housing to vary the vertical spacing thereof from the lamp, whereby horizontal size of said primary area of relatively bright illumination may be varied.

2. A lighting fixture as recited in claim 1 wherein each of said lamps tubes is selected to emanate light of any selected color, and wherein vertical surfaces of said louvers are finished in any desired combination of colors.

* * * * *